US009517382B2

(12) United States Patent
Payne

(10) Patent No.: US 9,517,382 B2
(45) Date of Patent: Dec. 13, 2016

(54) PUSHUP EXERCISE SYSTEM AND APPARATUS

(71) Applicant: Alan Payne, Montross, VA (US)

(72) Inventor: Alan Payne, Montross, VA (US)

( * ) Notice: Subject to any disclaimer, the term of this patent is extended or adjusted under 35 U.S.C. 154(b) by 0 days.

(21) Appl. No.: 14/924,270

(22) Filed: Oct. 27, 2015

(65) Prior Publication Data

US 2016/0271444 A1 Sep. 22, 2016

Related U.S. Application Data

(60) Provisional application No. 62/133,575, filed on Mar. 16, 2015.

(51) Int. Cl.

| | |
|---|---|
| ***A63B 26/00*** | (2006.01) |
| ***A63B 71/00*** | (2006.01) |
| ***A63B 21/062*** | (2006.01) |
| ***A63B 23/12*** | (2006.01) |
| ***A63B 21/00*** | (2006.01) |
| ***A63B 23/02*** | (2006.01) |

(52) U.S. Cl.
CPC ..... *A63B 23/1236* (2013.01); *A63B 21/00047* (2013.01); *A63B 23/0233* (2013.01)

(58) Field of Classification Search
CPC . A63B 23/1236; A63B 23/0233; A63B 23/12; A63B 23/1227; A63B 21/0047; A63B 21/4029; A63B 21/4027; A63B 21/06; A63B 21/062–21/0628; A63B 21/063–21/0635; A63B 21/078–21/0783; A63B 21/16; A63B 21/169
USPC ..... 482/92–96, 98–104, 141, 142, 148
See application file for complete search history.

(56) References Cited

U.S. PATENT DOCUMENTS

| | | | | |
|---|---|---|---|---|
| 2,666,640 A | | 1/1954 | Jennings, Sr. | |
| 3,207,511 A | | 9/1965 | Hoffman | |
| 3,874,657 A | * | 4/1975 | Niebojewski ..... | A63B 17/00 482/104 |

(Continued)

FOREIGN PATENT DOCUMENTS

WO 8402660 A1 7/1984

OTHER PUBLICATIONS

"What Muscles do Push-Ups Work?" accessed on Oct. 16, 2015 from http://www.md-health.com/What-Muscles-Do-Push-Ups-Work.html.

(Continued)

*Primary Examiner* — Steve R. Crow
*Assistant Examiner* — Garrett Atkinson
(74) *Attorney, Agent, or Firm* — Gerard M. Donovan; Reed Smith LLP

(57) ABSTRACT

An exercise system including a bar having a cushioned section and two non-cushioned sections configured for a user to grip while performing a pushup; a support apparatus, the support apparatus including: two side structures; a back structure affixed to an edge of each of the two side structures via one or more hinges, wherein the back structure is configured to be positioned against a wall; and a plurality of parallel slots formed in an edge of each of the two side structures opposite the edge of each side structure affixed to the back structure, wherein the parallel slots are configured to support the bar when a user performs a pushup; wherein the one or more hinges attaching each side structure to the back structure allow a user to transition the support apparatus between a deployed configuration and a storage configuration.

17 Claims, 6 Drawing Sheets

(56) References Cited

U.S. PATENT DOCUMENTS 4,358,106 A 11/1982 Shadford
4,923,194 A 5/1990 Montgomery
5,290,209 A 3/1994 Wilkinson
5,674,168 A * 10/1997 Wilkinson ..... A63B 22/0087 482/115
5,697,875 A 12/1997 Stan
5,711,749 A * 1/1998 Miller ..... A63B 23/0222 482/111
6,129,651 A 10/2000 Denaro
6,409,640 B2 * 6/2002 Cournoyer ..... 482/141
6,692,417 B2 * 2/2004 Burrell ..... A63B 21/00047 482/141
6,695,754 B1 * 2/2004 Gazzolo ..... A63B 23/12 482/141
7,125,371 B2 * 10/2006 Henderson ..... A63B 21/068 482/142
7,635,322 B2 * 12/2009 Parrilla ..... A63B 21/078 482/104
7,717,837 B2 * 5/2010 Florczak ..... A63B 1/00 482/143
7,824,319 B2 11/2010 Carlesimo et al.
7,871,360 B1 * 1/2011 Hoole ..... A63B 23/12 482/121
7,896,786 B1 * 3/2011 Osbourne ..... A63B 21/0552 482/122
7,905,816 B1 * 3/2011 Murphy ..... A63B 21/068 482/114
8,317,664 B2 * 11/2012 Gorsuch ..... A63B 3/00 211/149
8,343,021 B1 1/2013 Seraydarian et al.
D676,092 S * 2/2013 Bledson ..... D21/690
9,114,272 B2 * 8/2015 Fowler ..... A63B 17/00
2001/0004624 A1 * 6/2001 Cournoyer ..... A63B 21/068 482/141
2003/0057171 A1 * 3/2003 Wang ..... A47B 43/00 211/195
2008/0045390 A1 * 2/2008 Harms ..... A63B 23/12 482/141
2009/0124471 A1 * 5/2009 Storch ..... A63B 21/00047 482/141
2010/0190612 A1 * 7/2010 Cook ..... A63B 71/023 482/38
2011/0053738 A1 * 3/2011 Osbourne ..... A63B 21/0552 482/122
2011/0124476 A1 * 5/2011 Holley ..... A63B 23/02 482/121
2013/0237394 A1 * 9/2013 Fowler ..... A63B 17/00 482/142
2014/0296046 A1 * 10/2014 Doubilet ..... A63B 23/1236 482/141
2014/0315700 A1 * 10/2014 Stallman ..... A63B 21/00047 482/141
2015/0072843 A1 * 3/2015 Cameron ..... A63B 17/04 482/141
2015/0196799 A1 * 7/2015 Chua ..... A63B 23/1236 482/141
2016/0008656 A1 * 1/2016 Critelli ..... A63B 22/0046 482/95

OTHER PUBLICATIONS

Stuart Bradford, "An Enduring Measure of Fitness: The Simple Push-Up", New York Times.

* cited by examiner

PUSHUP EXERCISE SYSTEM AND APPARATUS

PRIORITY CLAIM

This application claims priority to the U.S. provisional patent application 62/133,575, filed Mar. 16, 2015, entitled "TOP BODY," which is hereby incorporated by reference.

BACKGROUND

Pushups, considered the ultimate body-weight exercise, target the chest, arms, triceps (back of upper arms), shoulders, back, neck, and abdominal muscles. An article, entitled "What Muscles do Push-Ups Work?" accessed from http://www.md-health.com/What-Muscles-Do-Push-Ups-Work.html and incorporated herein by reference, details the health benefits of pushups and the muscle groups worked. As explained in a New York Times article, entitled "An Enduring Measure of Fitness: The Simple Pushup" and incorporated herein by reference, "as a symbol of health and wellness, nothing surpasses the simple push-up."

To many persons pushups are difficult to perform. Indeed, as stated in the New York Times article, "many people simply can't do push-ups." To overcome this challenge, it is often recommended to place one's hands on a table, step, bed, or the like to elevate the torso. This becomes an incline pushup. While it is still working the muscles, it is easier on the person. The height of the furniture or step varies the degree of pushup muscle resistance. The taller the object, the less strenuous the pushup. Other persons, who may be more physically fit and want to increase the resistance and target specific muscles, may do decline pushups, with their feet higher than their heads and shoulders.

Using furniture, workout benches, and steps to increase or decrease pushup muscle resistance is not convenient. Nor does it easily allow for varying heights as strength increases. Further, it significantly limits where pushups can be performed. A number of apparatuses have been devised as improvements over using furniture, workout benches, and steps to increase or decrease the incline of a pushup and thus muscle resistance. Such apparatuses, however, typically take up a large amount of floor space, are inconvenient to use, offer only limited incline and decline options, are impractical to store, and do not allow for a natural pushup stance.

For example, U.S. Pat. Nos. 2,666,640 and 4,358,106 are fixed height exercise stands. While such exercise stands may provide a stable base and a determined height, they do not allow for various incline and decline positions.

U.S. Pat. Nos. 4,923,194, 6,129,651, 7,824,319, and 8,343,021 and U.S. Published Application Numbers 2009/0124471 and 2015/0072843 disclose apparatuses that include various mechanisms or structures that allow for incline pushups of various heights. Each, however, has drawbacks. For example, U.S. Pat. No. 8,343,021 can only be used with stairs, must be configured to fit a specific distance between adjacent cove molds on the flight of stairs, and requires a user to orient their hands perpendicular to the stair rungs. The others offer only limited options of height adjustability to vary the incline or decline, and do not fold for convenient storage.

U.S. Pat. Nos. 5,290,209, 5,697,875, and 7,905,816 and U.S. Published Application Numbers 2008/0045390, 2013/0237394, and 2014/0296046 disclose apparatuses that allow for incline pushups of various heights that can also be collapsed to some extent for storage purposes. Each apparatus, however, has a significant footprint when not collapsed and thus requires an inconvenient amount of space in order to be used. Each also includes complex mechanisms that may make it difficult for a user, such as an elderly person, to setup or store the apparatus.

Therefore, a need remains for a pushup exercise system and apparatus that is compact, convenient to use, offers broad options for incline and decline pushup positions, and is easy to store when not in use.

While embodiments of pushup exercise systems and apparatuses are described herein by way of examples and embodiments, those skilled in the art recognize that pushup exercise systems and apparatuses are not limited to the embodiments or drawings described herein. The drawings and descriptions are not intended to be limiting to the particular form disclosed. Rather, the intention is to cover all modifications, equivalents, and alternatives falling within the spirit and scope of the appended claims. Any headings used herein are for organizational purposes only and are not meant to limit the scope of the description or the claims. As used herein, the word "may" is used in a permissive sense (i.e., meaning having the potential to) rather than the mandatory sense (i.e., meaning must). Similarly, the words "include," "including," and "includes" mean including, but not limited to.

DETAILED DESCRIPTION

Various embodiments are disclosed herein of pushup exercise systems and apparatuses that may be adjusted to different heights. Embodiments allow for a bar to be placed at varying distances from the floor, for example anywhere from approximately 3.5 or 4 inches from the floor to approximately 34 inches from the floor, to allow a user to perform a less strenuous pushup. A user's strength may increase incrementally as they exercise, and the user may thus incrementally lower the bar position at their individual pace to facilitate more strenuous pushups. This is much like a runner starting with short jogs, not with marathons.

Figure 1A:
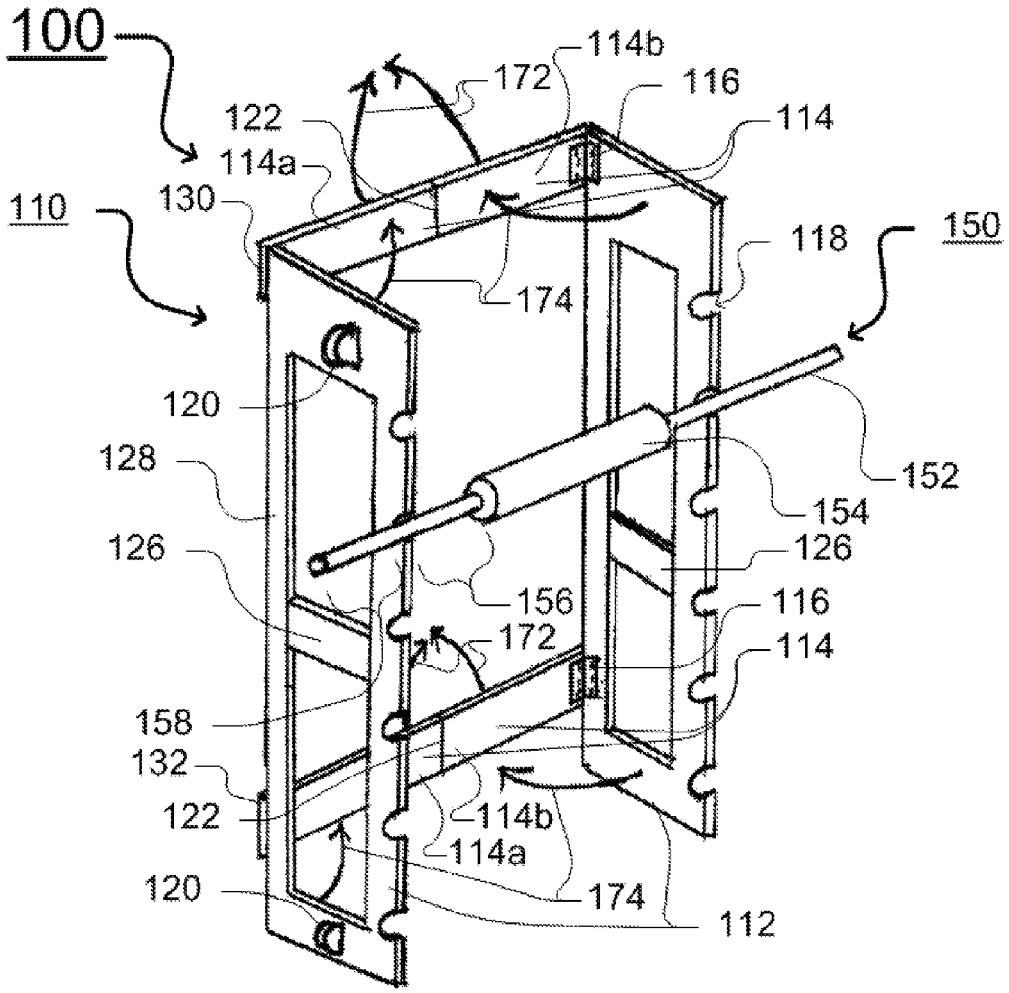
FIGS. 1A and 1B illustrate an exemplary pushup exercise system 100.
Figure 4:
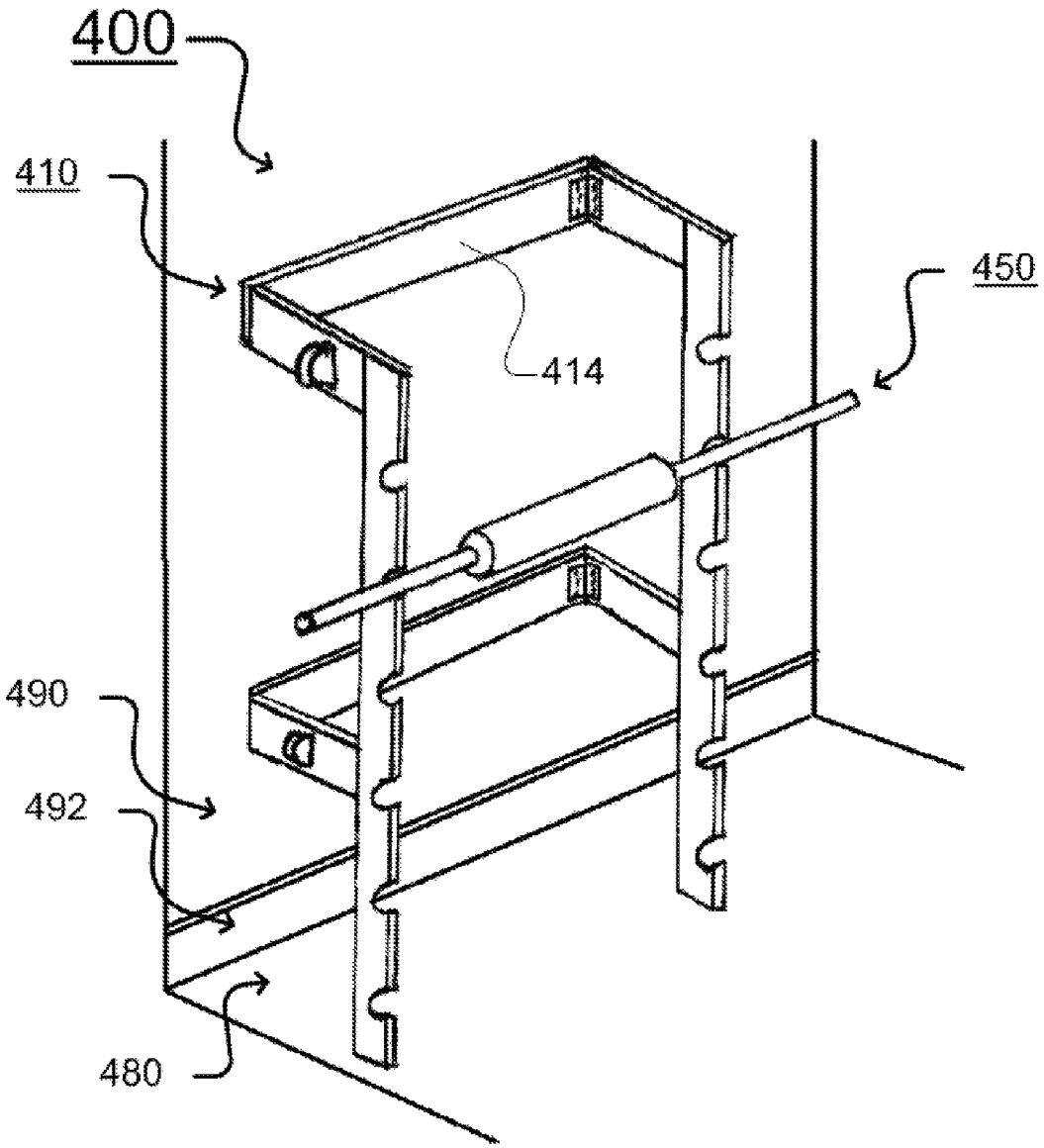
FIG. 4 illustrates an exemplary pushup exercise system 400 in a deployed configuration against a wall.

FIG. 1A illustrates an exemplary pushup exercise system 100. Pushup exercise system 100 is designed for persons of almost any age or physical condition. System 100 is comprised of a support apparatus 110 and a bar 150. When deployed, the back of support apparatus 110 is aligned against a wall, as illustrated in FIG. 4 below. The bar 150 may be placed in any set of parallel slots 118 to allow a user to select a desired incline for a pushup. In use, a user's weight pushes the back of support apparatus 110 solidly against a wall, thus supporting the user while performing pushups and reducing the risk of the system shifting during use.

Figure 2:
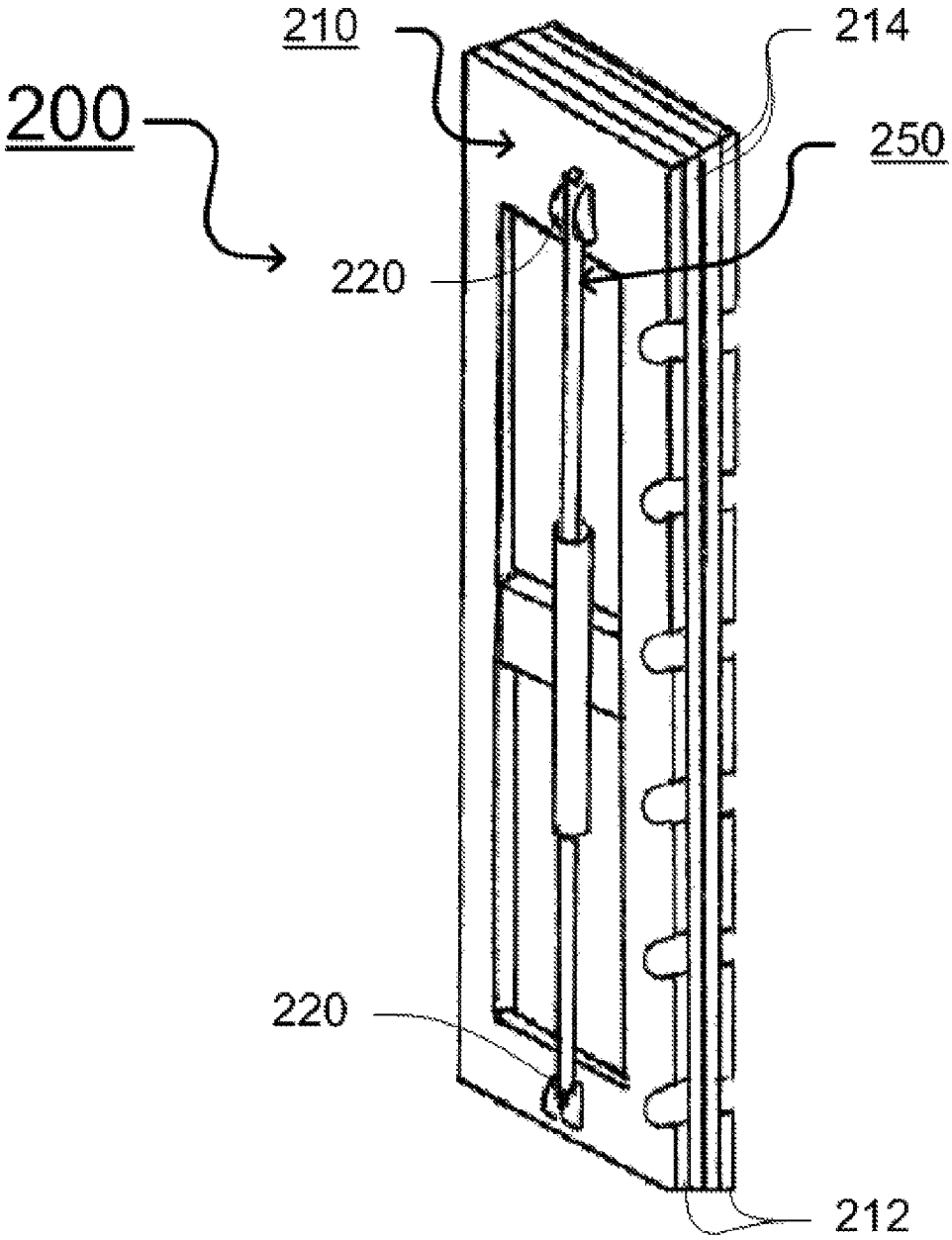
FIG. 2 illustrates an exemplary pushup exercise system 200 in a storage configuration.

Support apparatus 100 may include two side structures 112 each having an edge connected to a back structure 114 via hinges 116. Support apparatus is configured to allow a user to transition the support apparatus between a deployed configuration, as shown in FIG. 1A, and a storage configuration, as shown in FIG. 2. When in a deployed configuration, exercise system 100 allows a user to perform pushups. When in a storage configuration, exercise system 100 allows for easy movement or storage. In a deployed configuration, each of the two side structures 112 may be at or near a 90 degree angle to the back structure 114 such that the back structure is substantially parallel to the wall and the side structures 112 are substantially perpendicular to the wall.

Each side structure 112 may be formed from one or more separate components. Exemplary side structure 112 includes a primary structure 128 and a reinforcing structure 126 that may provide additional structural rigidity to primary structure 128. In alternative embodiments side structures 112 may comprise a single integrated (e.g., constructed from a single piece of metal, plastic, or wood) structure, similar to the side structures 312 shown in FIG. 3A. In still other embodiments, side structures 112 may comprise more than two components affixed together, similar to the side structures shown in FIG. 4.

Each side structure 112 may include a plurality of slots 118 formed on the edge of each side structure 112 opposite the edge of each of side structure 112 affixed to the back structure 114. The slots 118 may be configured to have bar 150 inserted into two parallel slots, one in each of the two side structures 112, to support bar 150 while a user performs a pushup. Because the slots are parallel, when the bar is rested in two parallel slots the bar is substantially parallel to the floor. The slots on opposite side structures 112 may be parallel to each other. Slots 118 may be distributed along the height of side structures 112 to enable a user to rest a bar in a specific slot to determine the incline of a pushup. Slots 118 may be spaced approximately 6 inches apart, however alternative embodiments may space slots 118 closer together or further apart to provide a greater or lesser degree of adjustability. A user may move the bar 150 to various slots 118 in order to increase or decrease the incline of a pushup. Support apparatus 110 may include, for example, six slots 118 spaced along the height of the side structures 112. The side structures 112 may each be, for example, anywhere from 32 to 40 inches tall. Alternative embodiments may be other heights and include more or less slots 118. The side structures may be sufficiently deep to allow a user's head and shoulders to protrude over the bar toward a wall when in the pushup position. For example, side structures may be 10 inches deep. The slots 118 may be angled so that the bar 150 cannot be released when supporting a user performing a pushup.

Back structure 114 may connect to the two side structures 112 via hinges 116. Hinges 116 may be any conventional hinge mechanism. Back structure 114 may include two sub-structures, 114*a* and 114*b*, meeting at a seam 122. The sub-structures 114*a* and 114*b* may be half the width of the back structure 114. A hinge (not shown in FIG. 1A) may be mounted on the side of back structure 114 facing away from the bar 150 at the seam 122 of sub-structures 114*a* and 114*b* to allow the back structure to fold. FIG. 1A illustrates an exemplary embodiment with back structure 114 having a top member 130 and a bottom member 132. In such an embodiment, top member 130 may be affixed to side structure 112 with a hinge at a height such that top member 130 is above a typical chair rail height, for example top member 130 may be affixed such that it is provides clearance over a chair rail about 36 inches above the floor, so as to enable system 100 to be usable in most home environments. Bottom member 130 may be affixed to side structure 112 with a hinge at a height such that bottom member 132 is above typical baseboards, for example above baseboards extending about 6 inches from the floor, so as to enable system 100 to be useable in most home environments.

Bar 150 may have a substantially cylindrical shape to allow the bar to rotate within a slot 118 while a user holds a firm grip on the bar throughout a pushup motion, thus not altering the correct pushup position at any angle or creating additional stress on the user's wrists. Bar 150 may have a sufficient length to enable a user to do pushups with his hands on the exterior portion of the bar 158 extending beyond side structures 112 or on the interior portion of the bar 156 extending between side structures 112. The two interior portions of the bar 156, each extending from each end of cushioned center section 154 to an interior face of a side structure 112, may each be between 5 and 10 inches long. The two exterior portions of the bar 158, each extending from an exterior face of a side structure 112 until an end of the bar, may each be between 5 and 10 inches long. Thus, a user may selectively perform wide-grip or close-in grip pushups to target specific muscle groups. Bar 150 may be, for example, 36 inches long.

Bar 150 may include a non-cushioned section 152 on each end of the bar 150 and a cushioned center section 154. The non-cushioned section 152 may be gripped to allow a user to perform pushups of varying inclines. A user may alternatively place feet or ankles on the cushioned center section 154 for decline pushups, which more greatly target the chest, shoulders, arms, and back for advanced upper body exercise. The non-cushioned sections 152 may also be useful for affixing bar 150 in one or more bar attachment structure 120 mounted to a side structure 112 for storage, as shown in FIG. 2. Bar attachment structure 120 may be, for example, a clip configured to grip bar 150.

While not shown in FIG. 1A, support structure 110 may include one or more mechanisms to lock the support structure in the deployed configuration. For example, support structure 100 may include a lock mechanism at seam 122 to lock the two sub-structures 114*a* and 114*b* together to form a rigid back structure 144. Support structure 110 may also include one or more lock mechanism configured to lock side structures 112 at a 90 degree angle to back structure 114 when in a deployed configuration. For embodiments having no locking structure, placement of bar 150 in slots 118 may provide reinforcement to stabilize the system 100 while a user performs pushups. For easy, compact storage and travel convenience, if not locked in the deployed configuration, bar 150 may be removed from the slots 118 and support structure 100 may be folded into a storage configuration, similar to the configuration shown in FIG. 2. A user may fold side structures 112 inward toward the center of back structure 114 in direction 174 and then fold the sides of back structure 114 and side structures 112 together inward in direction 172.

Figure 1B:
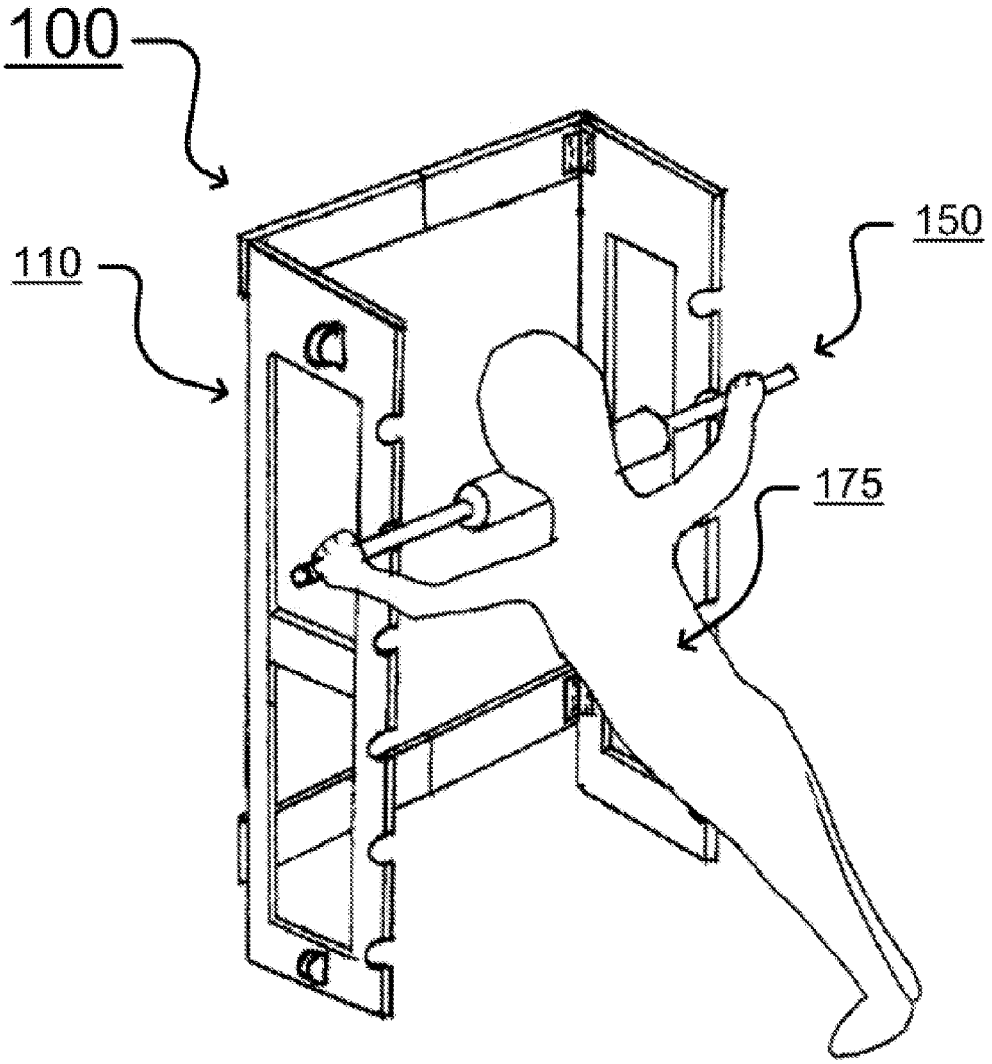

FIG. 1B illustrates a person or user 175 in a pushup position using pushup exercise system 100. As shown, user 175 may place his hands on the exterior portions 158 of the bar 150, as shown in FIG. 1A, to assume a wide-grip pushup position. By engaging the bar 150 in slots 118 near the top of support structure 100, the user 175 may perform less strenuous pushups than the user 175 would perform by engaging the bar 150 in slots 118 near the bottom of support structure 100. By allowing the user 175 to select the height of the bar 150, the user 175 can perform less strenuous pushups to begin a training regimen and incrementally increase the difficulty as the user 175 builds strength. By allowing user 175 to select the incline of the pushup, the health benefits of pushups can be realized by persons of any age group or fitness condition.

FIG. 2 illustrates an exemplary pushup exercise system 200 in a storage configuration with support apparatus 210 folded and holding bar 250. In the storage configuration, portions (e.g., halves) of the hinged back structure 214 are sandwiched between the side structures 212. While support apparatus 210 includes a back structure 214 comprising two solid panels, other embodiments, such as support apparatus 110 shown in FIG. 1A, may fold into a storage configuration in the same fashion. FIG. 2 also illustrates bar 250 secured in the bar attachment structure 220.

Figure 3A:
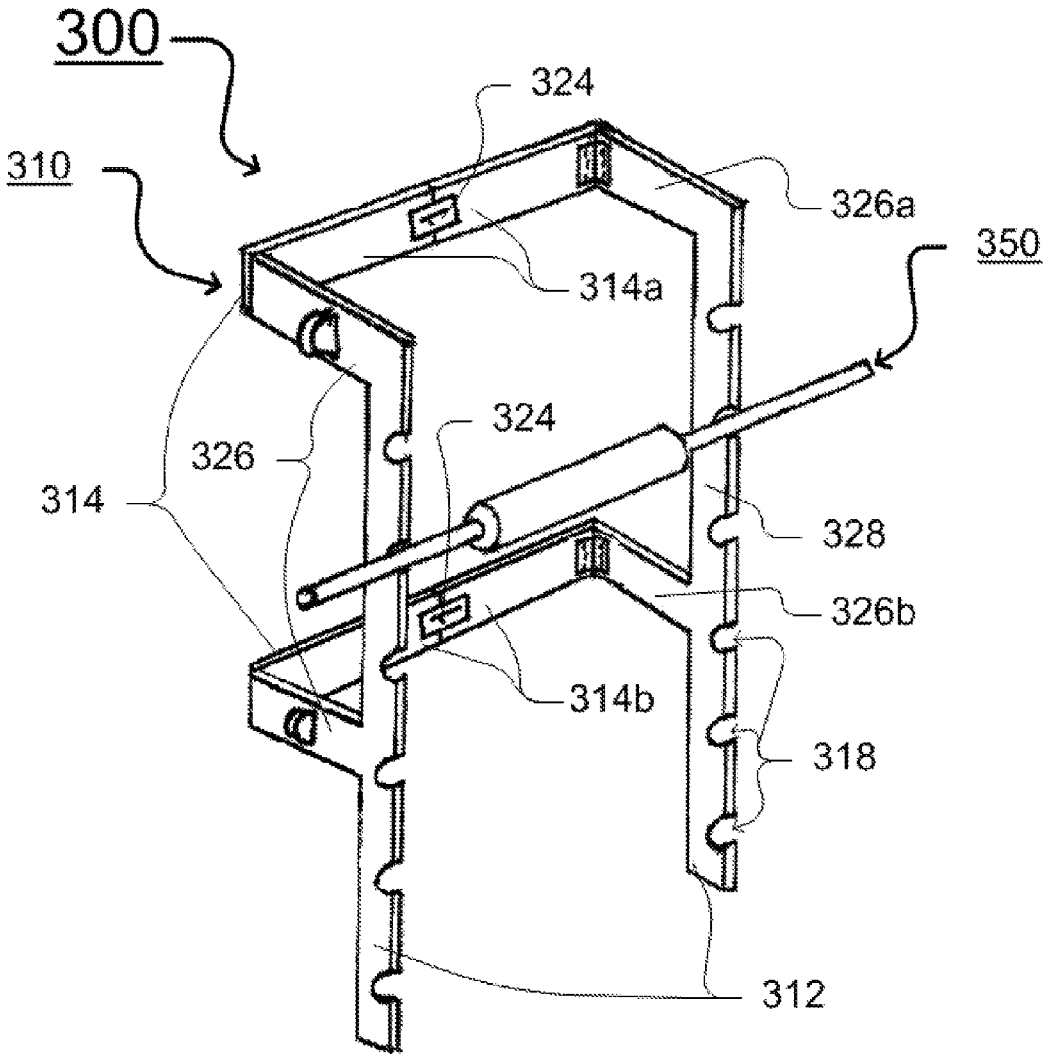
FIGS. 3A and 3B illustrate an exemplary reduced-weight pushup exercise system 300.
Figure 3B:
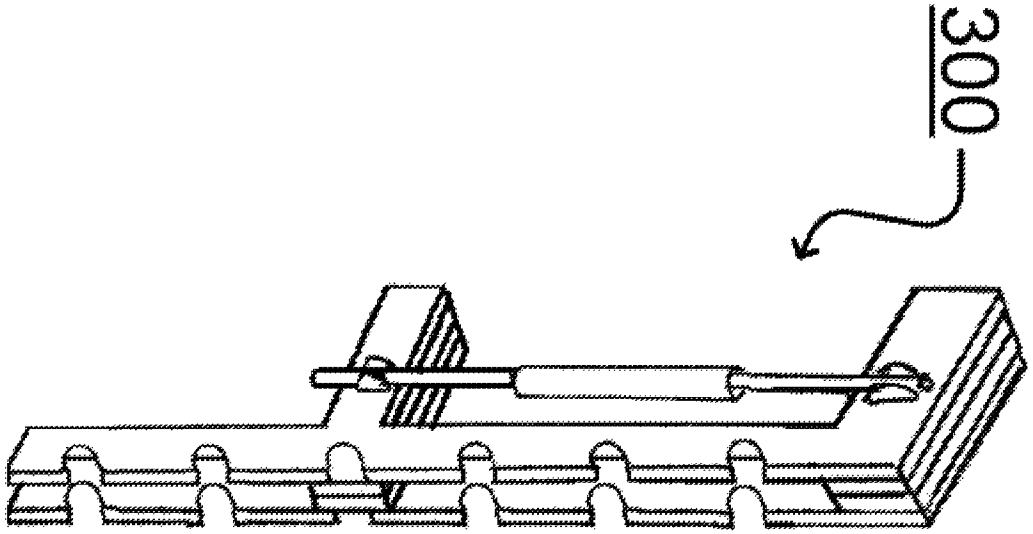

FIG. 3A illustrates an exemplary reduced-weight pushup exercise system 300. Exercise system 300 may include a bar 350 similar to the bar discussed in exercise system 100 above. Unlike the side supports illustrated in the above exemplary embodiments, support apparatus 310 includes two side structures 312, each having a single beam forming a primary structure 328 and two extension structures 326 for connecting side structures 312 to back structure 314. Extension structures 326 may be formed integrally with primary support structure 328 to form side structure 312 as shown. Alternatively, extension structures 326 may be separate structures affixed to primary structure 328. A top extension structure 326*a* may be affixed to a top member 314*a* of back structure 314 and a bottom extension structure 326*b* may be affixed to a bottom member 314*b* of back structure 314. Like the embodiment shown in FIG. 1A, each of the top member 314*a* and bottom member 314*b* comprising the back structure 314 may include two sub-structures meeting at a hinged seam to allow the back structure to be folded in half in a storage configuration. Support apparatus 310 may include one or more locking mechanisms 324 configured to lock the sub-structures in a fixed position, thereby disabling the hinge mechanism, when apparatus 310 is in a deployed configuration. As shown, reduced-weight pushup exercise system 300 may include a reduced structure and weigh less than pushup exercise system 100. FIG. 3B illustrates reduced-weight pushup exercise system 300 in a storage configuration.

FIG. 4 illustrates an exemplary pushup exercise system 400 in a deployed configuration against a wall 490. When a user puts their weight on bar 450 to perform a pushup, their body weight increases the force by which support apparatus 410 pushes against wall 490 and floor 480, thus increasing the stability of the exercise system 400. Because embodiments of the support apparatuses disclosed herein derive their support from a wall, they offer incredible support for almost any weight person. As shown, support structure 410 is configured such that a baseboard 490 does not interfere with the portions of support structure 410 configured to engage with the wall 490. Support structure 410 is configured with a solid, non-hinged back structure 414. Thus, support structure 410 in a storage configuration support structure 410 may fold to have thinner depth of, for example, three inches, in a storage configuration to allow for convenient storage if full width is not an issue. In contrast, the embodiment in FIG. 2 may, for example, have a depth of about four inches but a significantly reduced width in a storage configuration.

Embodiments may include standoffs on the back structures (e.g., back structure 414 in FIG. 4) with felt or other non-marking materials on a surface configured to contact the wall. The standoffs may provide clearance for wall socket plates (e.g., electric outlets) or other structures protruding slightly from a wall. Standoffs may also protect wall surfaces.

Embodiments of pushup exercise systems disclosed herein may take up less than two square feet of floor space and less than two feet of wall length in a deployed configuration and protrude only inches from a wall, for example three or four inches, when stored in a storage configuration. Thus, embodiments disclosed herein can easily be moved from one place to another and can be used almost anywhere. Additionally, embodiments allow for both incline and decline pushups of varying heights, thus the health benefits of pushups can be realized by any age group or fitness condition. Further, users of the exercise systems disclosed herein may progress through varying degrees of incline or decline as they build strength. The multiple grip positions and the ability to perform both incline and decline pushups also provide users with the ability to perform various exercises to target different muscle groups.

All publications and patent applications mentioned in this specification are herein incorporated by reference. Embodiments have been disclosed herein. However, various modifications can be made without departing from the scope of the embodiments as defined by the appended claims and legal equivalents.

What is claimed is:

1. An exercise support apparatus comprising:

two side structures;

a back structure affixed to an edge of each of the two side structures via one or more hinges, wherein the back structure is configured to be positioned against a wall; and a plurality of slots formed in a front edge of each of the two side structures opposite the edge of each side structure affixed to the back structure, wherein the slots are configured to support a bar when a user performs a pushup;

wherein the one or more hinges attaching each side structure to the back structure allow the user to transition the support apparatus between a deployed configuration and a storage configuration, wherein in the deployed configuration the back structure is substantially perpendicular to each of the two side structures and the two side structures are substantially parallel to each other, and wherein in the storage configuration the back structure and each of the two side structures are substantially parallel to each other, wherein the back structure comprises two sub-structures affixed together by one or more hinges, and wherein in a deployed configuration the exercise support apparatus is configured to allow the user to place the back structure against a wall, select a set of slots corresponding to a desired pushup incline from the plurality of slots, place the bar in the set of slots, and perform pushups, and wherein while performing pushups the user's weight pushes the back structure against the wall, thereby supporting the user while performing pushups.

2. The exercise support apparatus of claim 1, wherein the back structure includes a lock mechanism configured to lock the two sub-structures together to form a rigid back structure.

3. The exercise support apparatus of claim 1, wherein each side structure comprises:

a beam forming a primary structure, wherein the plurality of slots are formed in the beam; and two extension structures, where the extension structures are affixed to the back structure via the one or more hinges.

4. The exercise support apparatus of claim 3, wherein the back structure comprises:

a top member affixed via a first pair of hinges to a top extension structure of each side structure; and a bottom member affixed via a second pair of hinges to a bottom extension structure of each side structure, wherein the top member comprises the two sub-structures and the bottom member further comprises two additional sub-structures, each sub-structure having a hinge at a first end affixing it to one of the side structures and a hinge at a second end affixing it to another sub-structure.

5. The exercise support apparatus of claim 4, wherein the top member includes a locking mechanism configured to rigidly affix the two sub-structures comprising the top member and wherein the bottom member includes a locking mechanism configured to rigidly affix the two sub-structures comprising the bottom member.

6. The exercise support apparatus of claim 4, wherein the top member is positioned at least 36inches from a bottom end of each side structure.

7. The exercise support apparatus of claim 4, wherein the bottom member is positioned at least six inches from a bottom end of each side structure.

8. The exercise support apparatus of claim 1, further comprising one or more bar attachment structure mounted to one of the side structures and configured to vertically affix the bar to the exercise support apparatus for storage in the storage configuration.

9. The exercise support apparatus of claim 1, further comprising two or more standoffs extending from a face of the back support facing the wall, wherein a surface of the standoffs configured to contact the wall is comprised of a non-marking material.

10. The exercise support apparatus of claim 1, wherein the slots are angled so that the bar cannot be released when supporting the user performing a pushup.

11. An exercise system comprising:

a bar having a cushioned section and two non-cushioned sections configured for a user to grip while performing a pushup, wherein the bar has a substantially cylindrical shape;

a support apparatus, the support apparatus comprising:

two side structures;

a back structure affixed to an edge of each of the two side structures via one or more hinges, wherein the back structure is configured to be positioned against a wall; and a plurality of slots formed in a front edge of each of the two side structures opposite the edge of each side structure affixed to the back structure, wherein the slots are configured to support the bar when the user performs a pushup and to allow the bar to rotate while the user holds a grip on the bar throughout a pushup motion;

wherein the one or more hinges attaching each side structure to the back structure allow the user to transition the support apparatus between a deployed configuration and a storage configuration, wherein in the deployed configuration the back structure is substantially perpendicular to each of the two side structures and the two side structures are substantially parallel to each other, and wherein in the storage configuration the back structure and each of the two side structures are substantially parallel to each other, wherein the back structure comprises: a top member affixed via a first pair of hinges to a top extension structure of each side structure; and a bottom member affixed via a second pair of hinges to a bottom extension structure of each side structure, wherein each of the top member and the bottom member further comprises two sub-structures, each sub-structure having a hinge at a first end affixing it to one of the side structures and a hinge at a second end affixing it to another sub-structure.

12. The exercise system of claim 11, wherein the non-cushioned sections extend from each end of the bar to the cushioned section, and wherein when the bar is placed in the parallel slots the non-cushioned sections provide two interior portions configured to allow each hand of the user to grip the bar between the cushioned section and the side structure to perform close-in grip pushups and two exterior portions to allow each hand of the user to grip the outside of the side structure to perform wide-grip pushups.

13. The exercise system of claim 11, wherein each side structure comprises:

a beam forming a primary structure, wherein the plurality of slots are formed in the beam.

14. The exercise system of claim 13, wherein the top member includes a locking mechanism configured to rigidly affix the two sub-structures comprising the top member and wherein the bottom member includes a locking mechanism configured to rigidly affix the two sub-structures comprising the bottom member.

15. The exercise system of claim 13, wherein the top member is positioned at least 36 inches from a bottom end of each side structure.

16. The exercise system of claim 13, wherein the bottom member is positioned at least six inches from a bottom end of each side structure.

17. The exercise system of claim 13, wherein the slots are angled so that the bar cannot be released when supporting the user performing a pushup.

* * * * *